US007583256B2

(12) United States Patent
Park et al.

(10) Patent No.: US 7,583,256 B2
(45) Date of Patent: Sep. 1, 2009

(54) DISPLAY APPARATUS AND CONTROL METHOD THEREOF

(75) Inventors: Dong-sik Park, Suwon-si (KR); Young-chan Kim, Euiwang-si (KR); Sang-hak Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 659 days.

(21) Appl. No.: 11/196,327

(22) Filed: Aug. 4, 2005

(65) Prior Publication Data

US 2006/0033841 A1 Feb. 16, 2006

(30) Foreign Application Priority Data

Aug. 6, 2004 (KR) ..... 10-2004-0062087

(51) Int. Cl.
*G09G 5/00* (2006.01)

(52) U.S. Cl. ..... 345/204; 345/205; 345/206

(58) Field of Classification Search ..... 345/3.3, 345/691, 603, 329, 330, 698, 699, 501, 427, 345/204–206, 545, 424; 348/14.01, 536, 348/500, 552–559, 521, 540, 542, 443, 444, 348/458, 207.2; 709/233, 204; 386/17; 375/355; 358/518, 515; 351/206; 331/17; 382/128, 145, 152; 700/83
See application file for complete search history.

(56) References Cited

U.S. PATENT DOCUMENTS 4,090,218 A * 5/1978 van Buul et al. ..... 348/559
4,204,220 A * 5/1980 Rutishauser ..... 386/17
4,349,832 A * 9/1982 Gallo ..... 348/500
4,412,728 A * 11/1983 Sakane et al. ..... 351/206
4,737,772 A * 4/1988 Nishi et al. ..... 345/603
4,873,570 A * 10/1989 Suzuki et al. ..... 358/515
5,140,413 A * 8/1992 Suzuki et al. ..... 358/518
5,386,504 A * 1/1995 Yoda et al. ..... 715/798
5,422,996 A * 6/1995 Patil et al. ..... 345/501
5,486,868 A * 1/1996 Shyu et al. ..... 348/524

(Continued)

FOREIGN PATENT DOCUMENTS

JP 8-223513 8/1996

(Continued)

OTHER PUBLICATIONS

PCT Search Report issued on Nov. 10, 2005 in PCT/KR2005/002541.

*Primary Examiner*—Prabodh M. Dharia
(74) *Attorney, Agent, or Firm*—Stanzione & Kim LLP

(57) ABSTRACT

A method of controlling a display apparatus displaying a picture according to an input video signal including a horizontal synchronous signal and a vertical synchronous signal includes setting one or more exclusive display modes, setting whether to apply an auto-adjustment function to the video signal, determining a display mode of the video signal according to the horizontal and vertical synchronous signals when the auto-adjustment function is set to operate, and performing the auto-adjustment function when the determined display mode is not equal to any one of the one or more exclusive display modes. The display apparatus and the control method thereof selectively perform the auto-adjustment function according to the display mode of the input video signal.

20 Claims, 4 Drawing Sheets

U.S. PATENT DOCUMENTS

| | | | | |
|---|---|---|---|---|
| 5,625,419 | A * | 4/1997 | Pyeong | 348/568 |
| 5,754,798 | A * | 5/1998 | Uehara et al. | 710/104 |
| 5,819,048 | A * | 10/1998 | Okazaki et al. | 709/233 |
| 5,969,750 | A * | 10/1999 | Hsieh et al. | 348/14.1 |
| 5,986,636 | A * | 11/1999 | Wu | 345/691 |
| 6,078,948 | A * | 6/2000 | Podgorny et al. | 709/204 |
| 6,128,044 | A * | 10/2000 | Park | 348/556 |
| 6,211,884 | B1 * | 4/2001 | Knittel et al. | 345/424 |
| 6,229,860 | B1 * | 5/2001 | Chen | 375/355 |
| 6,317,161 | B1 * | 11/2001 | Renner et al. | 348/536 |
| 6,348,931 | B1 * | 2/2002 | Suga et al. | 345/699 |
| 6,380,967 | B1 * | 4/2002 | Sacca | 348/14.01 |
| 6,411,302 | B1 * | 6/2002 | Chiraz | 345/545 |
| 6,487,365 | B2 * | 11/2002 | Cookson et al. | 386/111 |
| 6,609,038 | B1 * | 8/2003 | Croswell et al. | 700/83 |
| 6,614,419 | B1 * | 9/2003 | May | 345/156 |
| 6,636,216 | B1 * | 10/2003 | Silverbrook et al. | 345/427 |
| 6,718,055 | B1 * | 4/2004 | Suri | 382/128 |
| 6,809,599 | B2 * | 10/2004 | Shimoda | 331/17 |
| 6,836,268 | B1 * | 12/2004 | Song | 345/204 |
| 7,034,812 | B2 * | 4/2006 | Chen et al. | 345/204 |
| 7,324,682 | B2 * | 1/2008 | Wasserman | 382/145 |
| 7,327,400 | B1 * | 2/2008 | Greenberg | 348/536 |
| 7,434,211 | B2 * | 10/2008 | Wynn et al. | 717/141 |
| 7,453,492 | B2 * | 11/2008 | Silverbrook | 348/207.2 |
| 2002/0089525 | A1 * | 7/2002 | Huang | 345/698 |
| 2002/0094119 | A1 * | 7/2002 | Sahadevan | 382/132 |
| 2002/0149542 | A1 * | 10/2002 | Song | 345/3.3 |
| 2003/0184532 | A1 * | 10/2003 | Chen et al. | 345/204 |
| 2004/0046707 | A1 * | 3/2004 | Mori et al. | 345/1.1 |
| 2004/0243940 | A1 * | 12/2004 | Lee et al. | 715/744 |
| 2005/0057435 | A1 * | 3/2005 | Su | 345/1.3 |
| 2005/0099437 | A1 * | 5/2005 | Kim et al. | 345/699 |
| 2005/0099540 | A1 * | 5/2005 | Elliott et al. | 348/458 |
| 2005/0213807 | A1 * | 9/2005 | Wasserman | 382/152 |

FOREIGN PATENT DOCUMENTS

| | | |
|---|---|---|
| JP | 09-212142 | 8/1997 |
| JP | 10-222137 | 8/1998 |
| KR | 2000-15939 | 8/2000 |
| KR | 2000-8689 | 12/2000 |
| KR | 2003-97310 | 12/2003 |
| KR | 2003-30644 | 3/2004 |

* cited by examiner

DISPLAY APPARATUS AND CONTROL METHOD THEREOF

CROSS-REFERENCE TO RELATED APPLICATIONS

This application claims priority under 35 U.S.C. § 119(a) from Korean Patent Application No. 2004-0062087, filed on Aug. 6, 2004, in the Korean Intellectual Property Office, the disclosure of which is incorporated herein by reference.

BACKGROUND OF THE INVENTION

1. Field of the Invention

The present general inventive concept relates to a display apparatus and a control method thereof, and more particularly, to a display apparatus and a control method thereof, in which an auto-adjustment function is performed according to display modes of an input video signal.

2. Description of the Related Art

Generally, a display apparatus receives a video signal of a predetermined display mode from a video signal source, such as a computer, a television broadcasting system, etc., thereby displaying a picture on a screen thereof. Such a display apparatus has been developed, that is, a cathode ray tube (CRT) has been replaced with a flat panel display, such as a liquid crystal display (LCD), a plasma display panel (PDP), etc.

As compared with a CRT type display apparatus, a flat panel display apparatus receives an analog video signal from a video signal source and converts the analog video signal into a digital video signal, thereby displaying a picture. Here, the flat panel display apparatus comprises an analog/digital (A/D) converter to convert the analog video signal into the digital video signal. Further, the digital video signal converted by the A/D converter is processed by a preset method and transmitted to an LCD panel or the PDP, thereby driving a pixel corresponding to the digital video signal and displaying the picture.

Meanwhile, a recently developed display apparatus has an additional function to change a display mode thereof properly when a resolution of the analog video signal is changed, which will be generally called an auto-adjustment function.

For example, the display mode of the video signal transmitted from the video signal source, such as a computer or the like, includes various resolutions of 640×480 at 60 Hz; 640×480 at 75 Hz; 800×600 at 60 Hz; 1024×768 at 60 Hz; 1600×1200 at 60 Hz; 1920×1200 at 60 Hz; and so on. Here, when the video signal having a resolution of 640×480 at 75 Hz is transmitted from the video signal source to the display apparatus being set to have the display mode based on a resolution of 1024×768 at 60 Hz, that is, when the resolution of the input video signal does not match the display mode of the display apparatus, the picture is not optimally displayed. Therefore, the auto-adjustment function compensates for a difference between the display mode of the display apparatus and the resolutions of the input video signal, thereby allowing the display apparatus to optimally display the picture according to the video signal.

Further, an auto-adjustment button is generally provided in a front of the display apparatus and used for performing the auto-adjustment function.

Also, there has been developed a display apparatus continuously applying the auto-adjustment function to the input video signal.

However, in a case of the display apparatus performing the auto-adjustment function using the auto-adjustment button, a user unskilled in the display apparatus is likely to misunderstand that a problem arises not in the display apparatus but in the video signal source, such as a computer, when a picture is not optimally displayed, e.g., when a position of a picture is moved to one side because the resolution of the input video signal does not match the display mode of the display apparatus.

Further, in a case of the display apparatus set to continuously apply the auto-adjustment function to the input video signal, the auto-adjustment function is performed even when the video signal outputted from the video signal source is temporarily changed in the display mode, e.g., in a case where the video signal provided during a booting process of the computer is different in the display mode from the video signal provided by an operating system of the computer. Thus, a user unskilled in the display apparatus is likely to regard alteration in a picture arising while the auto-adjustment function is performed, as an error occurring in the display apparatus or the computer. Particularly, in a case of the computer, the video signal provided during the booting process of the computer is very different in the resolution from the video signal provided by the operating system. Further, the video signal provided during the booting process of the computer has a lot of black regions, so that it is difficult to apply the auto-adjustment function to this video signal, so that the user is more likely to misunderstand that the computer or the display apparatus is in trouble.

SUMMARY OF THE INVENTION

The present general inventive concept provides a display apparatus and a control method thereof, in which an auto-adjustment function is performed according to display modes of an input video signal.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing a method of controlling a display apparatus displaying a picture based on an input video signal including a horizontal synchronous signal and a vertical synchronous signal, the method comprising setting one or more exclusive display modes, setting whether to apply an auto-adjustment function to the video signal, determining a display mode of the video signal according to the horizontal and vertical synchronous signals when the auto-adjustment function is set to operate, and performing the auto-adjustment function when the determined display mode is not equal to any one of the one or more exclusive display modes.

The one or more exclusive display modes may include the display mode of the video signal provided during a booting process of a computer that outputs the video signal to the display apparatus.

The performing of the auto-adjustment function may comprise detecting a back porch interval of the video signal according to the horizontal and vertical synchronous signals, detecting an H-total value of the video signal according to the horizontal and vertical synchronous signals, and performing the auto-adjustment function either when the detected back porch interval is not equal to a preset back porch interval or when the detected H-total value is not equal to a preset H-total value.

The foregoing and/or other aspects and advantages of the present general inventive concept may also be achieved by providing a display apparatus to display a picture based on an input video signal including a horizontal synchronous signal and a vertical synchronous signal, the display apparatus comprising a data storage to store information about one or more exclusive display modes, an auto-adjustment setter to set whether to apply an auto-adjustment function to the video signal, and a controller to determine a display mode of the video signal according to the horizontal and vertical synchronous signals when the auto-adjustment function is set to operate by the auto adjustment setter, and to perform the auto-adjustment function when the determined display mode is not equal to any one of the one or more exclusive display modes.

The one or more exclusive display modes may include the display mode of the video signal provided during a booting process of a computer that outputs the video signal to the display apparatus.

The controller may detect either a back porch interval or an H-total value of the video signal according to the horizontal and vertical synchronous signals, and may perform the auto-adjustment function either when the detected back porch interval is not equal to a preset back porch interval or when the detected H-total value is not equal to a preset H-total value.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
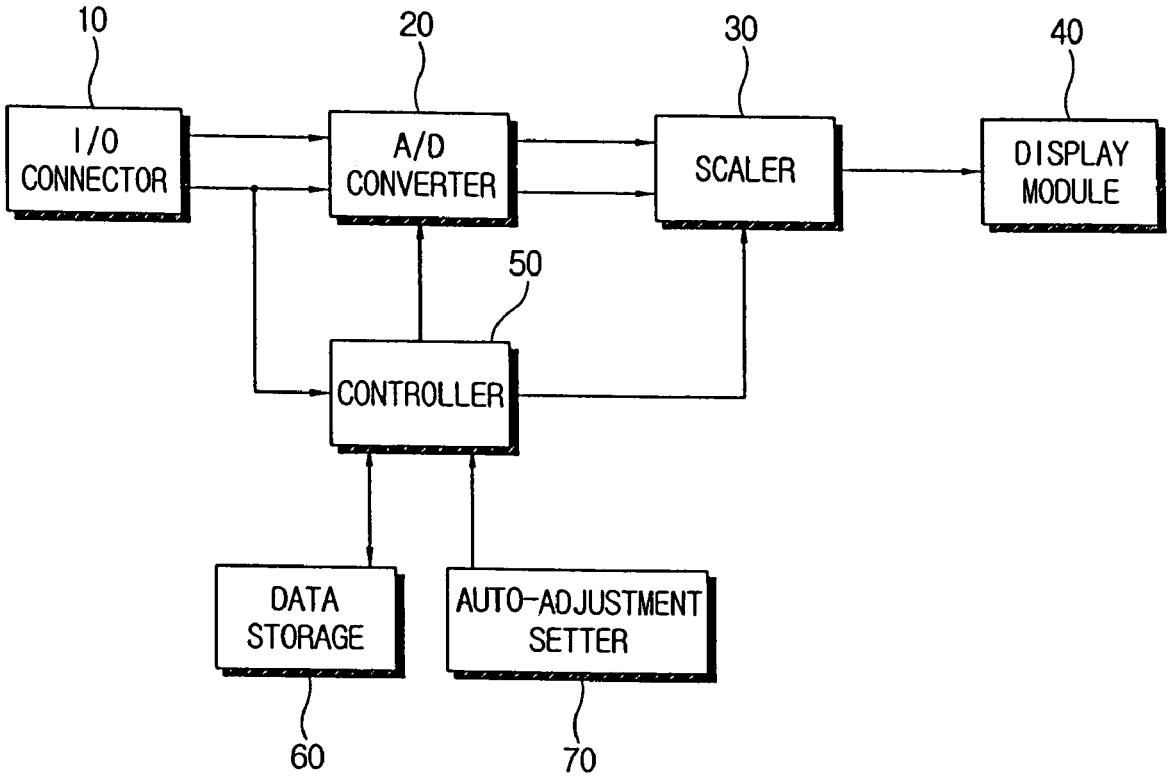
FIG. 1 is a control block diagram illustrating a display apparatus according to an embodiment of the present general inventive concept.

Reference will now be made in detail to the embodiments of the present invention, examples of which are illustrated in the accompanying drawings, wherein like reference numerals refer to like elements throughout. The embodiments are described below in order to explain the present general inventive concept by referring to the figures.

As shown in FIG. 1, a display apparatus according to an embodiment of the present general inventive concept comprises an I/O connector 10, an A/D converter 20, a scaler 30, a display module 40, a data storage 60, an auto-adjustment setter 70, and a controller 50.

The I/O connector 10 receives an analog video signal from a video signal source, such as a computer, a television broadcasting system, or the like. The analog video signal includes analog video data, and horizontal and vertical synchronous signals.

The I/O connector 10 may comprise one of various types of connectors to receive the video signal of various formats. For example, the I/O connector 10 may be at least one of a D-sub connector, a composite video broadcast signal (CVBS) connector, an S-video connector, and a component connector in order to receive the analog video signal.

The A/D converter 20 converts the analog video signal inputted through the I/O connector 10 into a digital video signal. Further, the digital video signal outputted from the AD converter 20 is scaled through the scaler 30 and transmitted to the display module 40.

The display module 40 displays a picture on a screen according to the digital video signal received from the scaler 30. The display module 40 includes an LCD module, a PDP module or the like as long as it can display the picture according to the digital video signal outputted from the scaler 30.

The auto-adjustment setter 70 is employed to set whether to perform an auto-adjustment function. The auto-adjustment setter 70 can be provided as a button placed in a front of the display apparatus, or as a remote controller. When the auto-adjustment function is set to operate by a user through the auto-adjustment setter 70, the controller 50 controls the auto-adjustment function to be continuously applied to the input video signal.

The data storage 60 stores information about one or more exclusive display modes. Here, the one or more exclusive display modes may include a display mode of a video signal to which the controller 50 does not apply the auto-adjustment function even though the auto-adjustment function is set to operate through the auto-adjustment setter 70.

The one or more exclusive display modes may include a display mode of a video signal transmitted from a computer to the display apparatus when the computer is booted. The video signal outputted when the computer is booted, may include one of the display modes, such as resolutions of 640×350 at 85 Hz; 640×480 at 60 Hz; 720×400 at 85 Hz; 800×600 at 60 Hz; and so on, which can be selected as the exclusive display mode. The one or more exclusive display mode can be input to the data storage 60 through an input unit provided in the display apparatus or the video input source, such as the computer.

The controller 50 controls the A/D converter 20, the scaler 30 and the display module 40 according to a preset setting variance in order to adjust a display state of a picture displayed on the display module 40. Here, the setting variance to adjust the display state of the picture can be stored in a memory (not shown), such as an EEPROM (electrical erasable programmable read only memory), or can be stored in the data storage 60.

Further, the controller 50 determines the display mode of the input video signal according to the horizontal and vertical synchronous signals inputted through the I/O connector 10. Here, when the determined display mode matches one of the one or more exclusive display modes, the controller 50 does not perform the auto-adjustment function even though the auto-adjustment function is set to operate. That is, when the auto-adjustment function is set to operate, the controller 50 performs the auto-adjustment function only when the determined display mode does not match any one of the one or more exclusive display modes.

Figure 2:
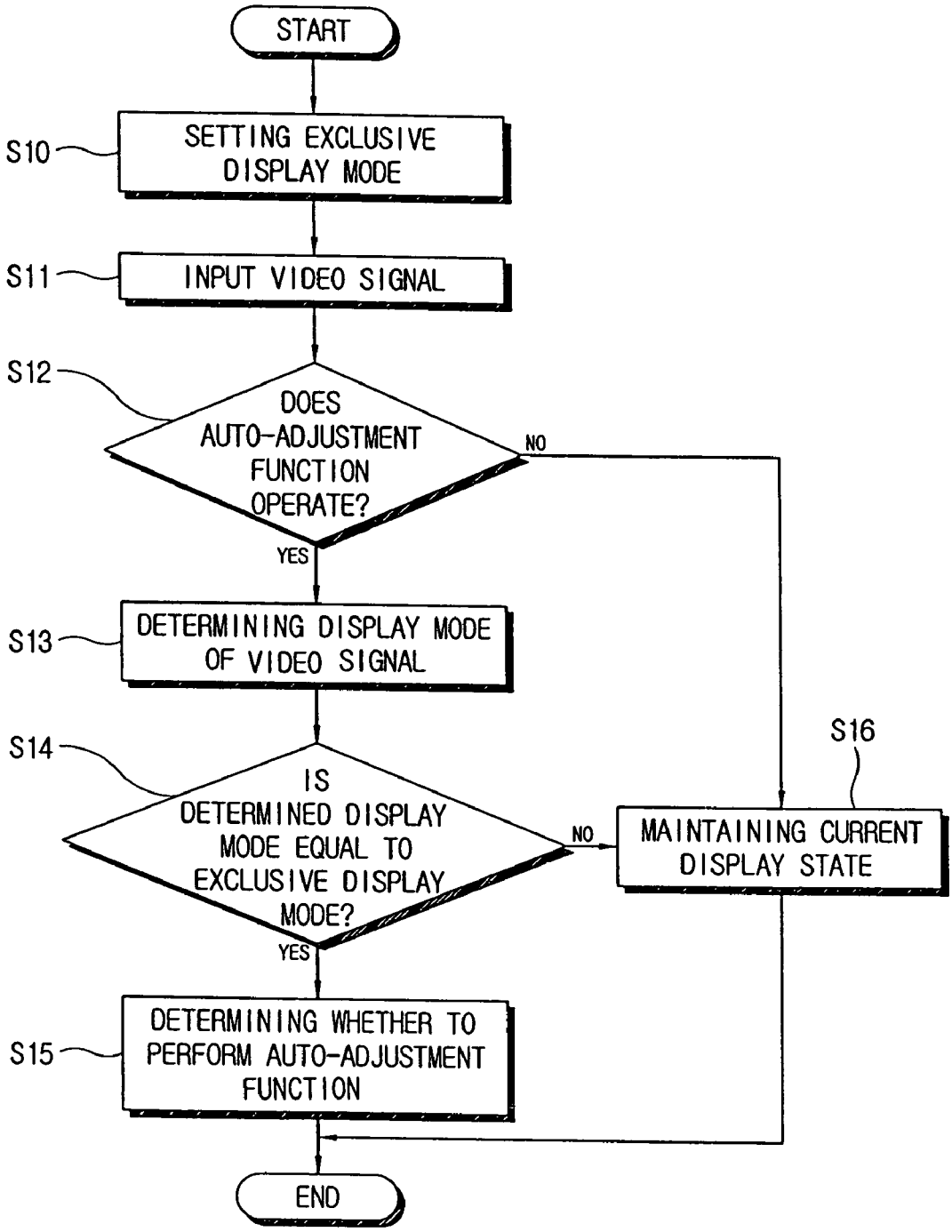
FIGS. 2 and 3 are control flowcharts illustrating a method of a display apparatus according to an embodiment of the present general inventive concept.

Hereinbelow, a method of controlling a display apparatus according to another embodiment of the present general inventive concept will be described with reference to FIGS. 1 and 2.

First, at operation S10, the exclusive display modes are selected and stored in the data storage 60. At operation S11, when a video signal is inputted, at operation S12, the controller 50 checks whether the auto-adjustment function is set to operate or not. In this embodiment, resolutions of 640×350 at 85 Hz; 640×480 at 60 Hz; 720×400 at 85 Hz; and 800×600 at 60 Hz may be selected as the one or more exclusive display modes.

When the auto-adjustment function is set to operate, at operation S13, the controller 50 determines the display mode of the video signal according to the horizontal and vertical synchronous signals.

Then, at operation S14, the controller 50 determines whether the determined display mode matches one of the one or more exclusive display modes. At this time, when the determined display mode matches one of the one or more exclusive display modes, e.g., when the video signal has a display mode of 800×600 at 60 Hz, at operation S16, the controller 50 does not perform the auto-adjustment function and maintains the display state of the picture displayed on the display module 40 as currently displayed. Here, when it is checked that the auto-adjustment function is set not to operate at the operation S12, the controller 50 maintains the display state of the picture displayed on the display module 40 as currently displayed, at operation S16.

On the other hand, when the determined display mode does not match any one of the one or more exclusive display modes, the controller 50 determines whether to perform the auto-adjustment function according to the display mode of the input video signal.

Figure 3:
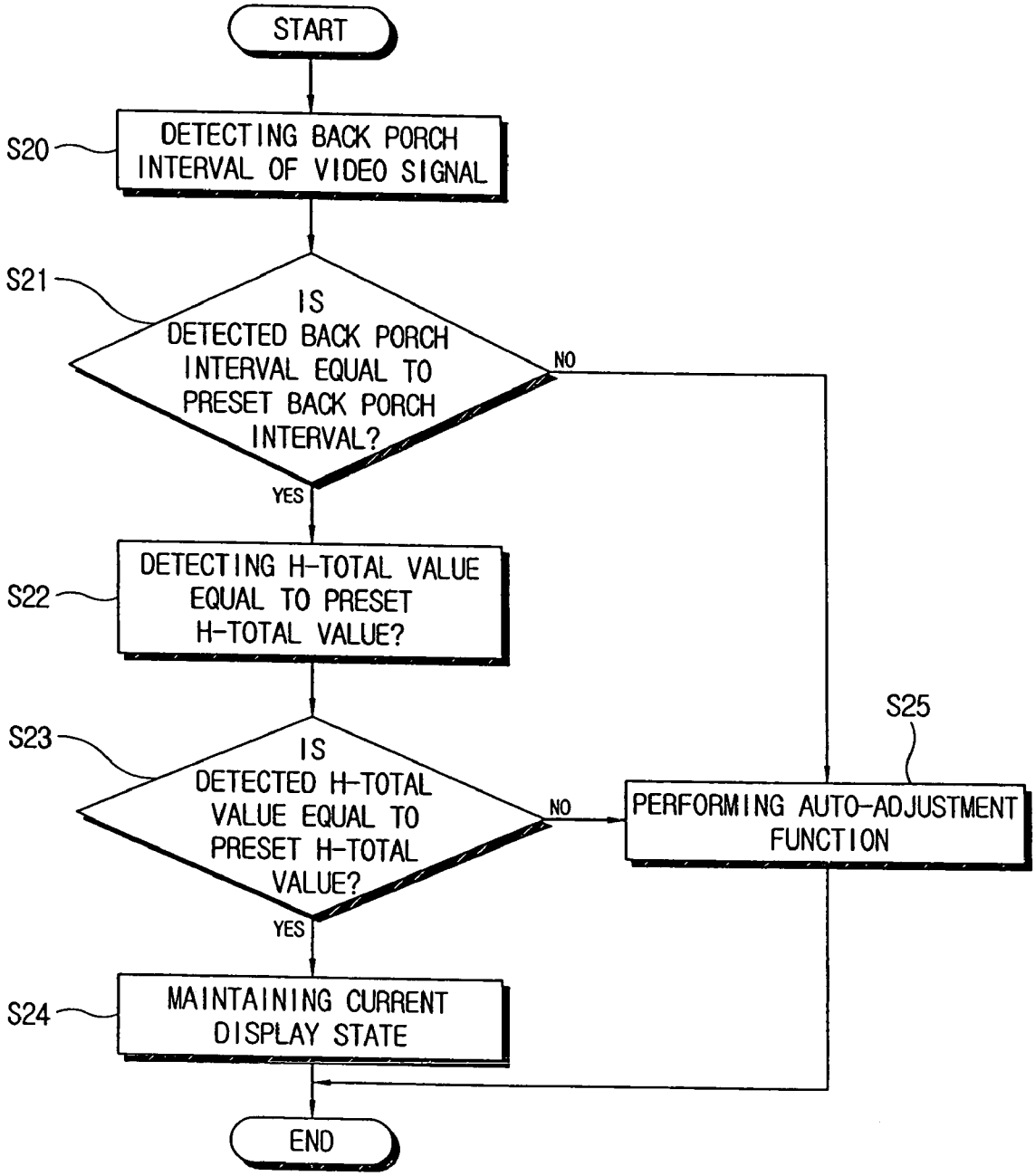
Figure 4:
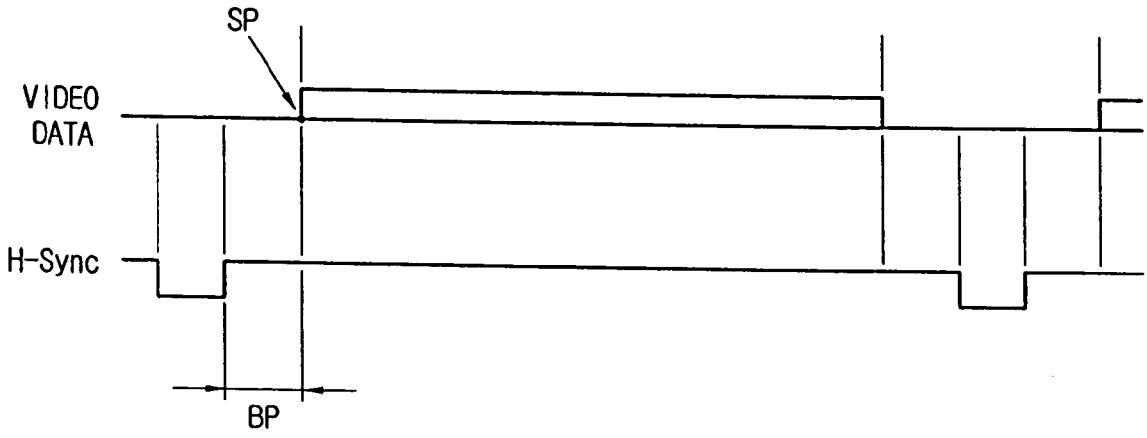
FIG. 4 is a view illustrating a timing chart between image data and a horizontal synchronous signal of a video signal in the method of the display apparatus of FIGS. 1 through 3.

Hereinbelow, the process of determining whether to apply the auto adjustment function to the input video signal in the controller 50 at the operation S15 of FIG. 2 will be described with reference to FIGS. 1 through 3.

First, at operation S20, the controller 50 detects a back porch (BP) interval of the input video signal from the horizontal and vertical synchronous signals. Here, the BP interval represents an interval between the horizontal synchronous signal and a start point (SP) of effective video data of the input video signal.

Then, at operation S21, the controller 50 determines whether the detected BP interval is equal to a preset BP interval. When the detected BP interval is not equal to the preset BP interval, at operation S25, the controller 50 controls the A/D converter 20, the scaler 30 and the display module 40 to perform the auto-adjustment function.

On the other hand, when the detected BP interval is equal to the preset BP interval, at operation S22, the controller 50 detects an H-total value of the video signal from the horizontal and vertical synchronous signals.

Then, at operation S23, the controller 50 determines whether the detected H-total value is equal to a preset H-total value or not. When the detected H-total value is not equal to a preset H-total value, at operation S25, the controller 50 controls the A/D converter 20, the scaler 30 and the display module 40 to perform the auto-adjustment function.

Oppositely, when the detected H-total value is equal to the preset H-total value, at operation S24, the controller 50 maintains the display state of the picture displayed on the display module 40 as currently displayed.

In the foregoing embodiment, the process of detecting the BP interval is performed prior to the process of detecting the H-total value. However, the process of detecting the H-total value may be performed prior to the process of detecting the BP interval.

As described above, the auto-adjustment function is performed according to the display modes of the video signal by selecting one or more exclusive display modes, setting whether to apply the auto-adjustment function to the video signal, determining the display mode of the video signal according to the horizontal and vertical synchronous signal when the auto-adjustment function is set to operate, and performing the auto-adjustment function when the determined display mode does not match any one of the one or more exclusive display modes.

Thus, even though the video signal provided at the booting process of the computer or the like is different in the display mode from the video signal provided by the operating system, the auto-adjustment function is not applied to the video signal provided during the booting process.

As described above, the present general inventive concept provides a display apparatus and a control method thereof, in which an auto-adjustment function is performed according to display modes of an input video signal.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A method of controlling a display apparatus displaying a picture based on an input video signal including a horizontal synchronous signal and a vertical synchronous signal, the method comprising:

setting one or more exclusive display modes which the video signal outputted from a video signal source is temporarily changed;

setting whether to apply an auto-adjustment function to the video signal;

determining a display mode of the video signal according to the horizontal and vertical synchronous signals when the auto-adjustment function is set to operate; and performing the auto-adjustment function when the determined display mode is not equal to any one of the one or more exclusive display modes.

2. The method according to claim 1, wherein the one or more exclusive display modes include the display mode of the video signal provided during a booting process of a computer that outputs the video signal to the display apparatus.

3. The method according to claim 2, wherein the performing of the auto-adjustment function comprises:

detecting a back porch interval of the video signal from at least one of the horizontal and vertical synchronous signals;

detecting an H-total value of the video signal from at least one of the horizontal and vertical synchronous signals; and performing the auto-adjustment function either when the detected back porch interval is not equal to a preset back porch interval or when the detected H-total value is not equal to a preset H-total value.

4. A display apparatus displaying a picture based on an input video signal including a horizontal synchronous signal and a vertical synchronous signal, the display apparatus comprising:

a data storage to store information about one or more exclusive display modes which the video signal outputted from a video signal source is temporarily changed;

an auto-adjustment setter to set whether to apply an auto-adjustment function to the video signal; and a controller to determine a display mode of the video signal according to the horizontal and vertical synchronous signals when the auto-adjustment function is set to operate by the auto adjustment setter, and to perform the auto-adjustment function when the determined display mode is not equal to any one of the exclusive display modes.

5. The display apparatus according to claim 4, wherein the one or more exclusive display modes include the display mode of the video signal provided during a booting process of a computer that outputs the video signal to the display apparatus.

6. The display apparatus according to claim 5, wherein the controller detects either a back porch interval or an H-total value of the video signal from at least on of the horizontal and vertical synchronous signals, and performs the auto-adjustment function either when the detected back porch interval is not equal to a preset back porch interval or when the detected H-total value is not equal to a preset H-total value.

7. A display apparatus, comprising:

a data storage to store information about one or more exclusive display modes which the video signal outputted from a video signal source is temporarily changed; and a controller to apply an auto-adjustment function to an input video signal when a display mode of the input video signal is not equal to any one of the one or more exclusive display modes.

8. The display apparatus according to claim 7, further comprising:

a display module; and a scaler to selectively adjust a display state of the input video signal according to a first display state, in which the auto-adjustment function is applied, and a second display state, in which the auto-adjustment function is not applied, so that a picture corresponding to the input video signal is displayed on the display module according to the selectively adjusted display state.

9. The display apparatus according to claim 8, wherein the scaler adjusts the display state of the input video signal according to the first display state when the display mode of the input video signal is not the one or more exclusive display modes, and adjusts the display state of the input video signal according to the second display state when the display mode of the input video signal is one of the one or more exclusive display modes.

10. The display apparatus according to claim 7, wherein the controller prevents the auto-adjustment function from being automatically applied to the input video signal.

11. The display apparatus according to claim 7, wherein the input video signal is generated from a computer during booting the computer.

12. The display apparatus according to claim 7, wherein the input video signal comprises horizontal and vertical synchronous signals, and the controller selectively applies the auto-adjustment function to the input video signal according to a characteristic of at least one of the horizontal and vertical synchronous signals.

13. The display apparatus according to claim 12, wherein the characteristic of the at least one of the horizontal and vertical synchronous signals comprises a back porch interval.

14. The display apparatus according to claim 12, wherein the characteristic of the at least one of the horizontal and vertical synchronous signals comprises an H-total value of the input video signal.

15. The display apparatus according to claim 12, further comprising:

an auto-adjustment setter to set the auto-adjustment function to be applied to input video signals having different display modes, wherein the controller prevents the auto-adjustment function from being applied to the input video signal according to the display mode of the input video signal, the one or more exclusive display modes, and the characteristic of the at least one of the horizontal and vertical synchronous signals.

16. The display apparatus according to claim 7, further comprising:

an auto-adjustment setter to set the controller to apply the auto-adjustment function to the input video signal, wherein the controller does not apply the auto-adjustment function to the input video signal when the display mode of the input video signal corresponds to the one or more exclusive display modes.

17. The display apparatus according to claim 7, wherein the one or more exclusive display modes is one of resolutions of 640×350 at 85 Hz, 640×480 at 60 Hz, 720×400 at 85 Hz, and 800×600 at 60 Hz.

18. A method of controlling a display apparatus displaying a picture corresponding to an input video signal, the method comprising:

storing information about one or more exclusive display modes which the video signal outputted from a video signal source is temporarily changed; and applying an auto-adjustment function to an input video signal when a display mode of the input video signal is not equal to an one of the one or more exclusive display modes.

19. A display apparatus, comprising:

a data storage to store information about one or more exclusive display modes which the video signal outputted from a video signal source is temporarily changed; and a controller to compare a display mode of the input video signal and the one or more exclusive display modes, and to a an auto adjustment when the determined display mode is not equal to any one of the one or more exclusive display modes.

20. A method of controlling a display apparatus displaying a picture corresponding to an input video signal, the method comprising:

storing information about one or more exclusive display modes which the video signal outputted from a video signal source is temporarily changed; and comparing a display mode of the input video signal with the one or more exclusive display modes, and applying an auto adjustment when the determined display mode is not equal to an one of the one or more exclusive display modes.

* * * * *

UNITED STATES PATENT AND TRADEMARK OFFICE

CERTIFICATE OF CORRECTION

PATENT NO. : 7,583,256 B2
APPLICATION NO. : 11/196327
DATED : September 1, 2009
INVENTOR(S) : Park et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 869 days.

Signed and Sealed this

Fourteenth Day of September, 2010

David J. Kappos

David J. Kappos
*Director of the United States Patent and Trademark Office*